US005886481A

United States Patent [19]

Flory, IV

[11] Patent Number: 5,886,481

[45] Date of Patent: Mar. 23, 1999

[54] REDUCED DUTY CYCLE HIGH INTENSITY DISCHARGE LAMP IGNITOR

[75] Inventor: Isaac L. Flory, IV, Blacksburg, Va.

[73] Assignee: Hubbell Incorporated, Orange, Conn.

[21] Appl. No.: 857,219

[22] Filed: May 15, 1997

[51] Int. Cl.[6] ..... H05B 41/14

[52] U.S. Cl. ..... 315/290; 315/309

[58] Field of Search ..... 315/290, 289, 315/309

[56] References Cited

U.S. PATENT DOCUMENTS

| | | | |
|---|---|---|---|
| 4,097,838 | 6/1978 | Fiala | 367/139 |
| 5,019,751 | 5/1991 | Flory, IV et al. | 315/290 |
| 5,210,471 | 5/1993 | Nuckolls et al. | 315/289 |
| 5,594,308 | 1/1997 | Nuckolls et al. | 315/290 |

FOREIGN PATENT DOCUMENTS

| | | | |
|---|---|---|---|
| 54-152365 | 11/1979 | Japan | 315/289 |
| 2137410 | 10/1984 | United Kingdom | 315/289 |

*Primary Examiner*—Robert Pascal
*Assistant Examiner*—Justin P. Bettendorf
*Attorney, Agent, or Firm*—Jerry M. Presson; William C. Roch

[57] ABSTRACT

A reduced cycle ignitor circuit for a high intensity discharge lamp incorporating a thermally timed, cycled operation which provides intermittent starting pulses for the high intensity discharge lamp. The ignitor circuit comprises a capacitor and semiconductor connected in series with a ballast transformer. The ignitor circuit further comprises a series connected resistor and thermostat, having thermally operated, normally closed electrical contacts, through which current is conducted to charge the capacitor. The thermostat is thermally coupled to the resistor. During operation, current flows through the series connected resistor and thermostat and charges the capacitor to a breakover threshold voltage level of the semiconductor. At that point, the semiconductor conducts and the energy stored in the capacitor is discharged through the semiconductor and a winding of the ballast which, through auto-transformer action, generates a high voltage pulse to start the high intensity discharge lamp. The resistor heats the thermostat during the charging cycle which reaches a temperature at which the normally closed thermostat contacts open, which disables the ignitor circuit until the resistor and thermostat cool and the thermostat contacts close.

17 Claims, 2 Drawing Sheets

REDUCED DUTY CYCLE HIGH INTENSITY DISCHARGE LAMP IGNITOR

BACKGROUND OF THE INVENTION

1. Field of the Invention

The present invention relates generally to a reduced duty cycle ignitor circuit for a high intensity discharge lamp, and more particularly pertains to a reduced duty cycle ignitor circuit for a High Intensity Discharge (HID) lamp which incorporates a thermally timed cycled operation which provides intermittent starting pulses for the HID lamp. The intermittent starting pulses should provide reduced stress on the ballast, socket and wiring dielectric systems of the HID lamp and result in longer electrical lives therefor.

2. Discussion of the Prior Art

One drawback to conventional HID ignitor ballast circuits is that when the HID lamp fails or is removed from the ballast circuit, the ignitor continuously generates high voltage pulses which over time will stress the ballast, socket and wiring dielectric systems. This can result in shorter electrical lives for those systems, particularly for the ballast system. As a response to this problem, several companies have introduced HID lamp ignitors which disable the ignitor after a predetermined period of time, thereby reducing the stress on the ballast, socket, and wiring dielectric systems.

SUMMARY OF THE INVENTION

Accordingly, it is a primary object of the present invention to provide a reduced duty cycle high intensity discharge lamp ignitor.

A further object of the subject invention is the provision of a reduced duty cycle ignitor circuit for a high intensity discharge lamp which incorporates a thermally timed cycled operation which provides intermittent starting pulses for the HID lamp. This provides reduced stress on the ballast, socket and wiring dielectric systems which should result in longer electrical lives therefor.

The basic functional difference between the HID ignitor of the present invention and prior art HID ignitors is that the ignitor of the subject invention cycles on and off during extended periods of operation.

The ignitor circuit of the present invention operates in a normal mode for several minutes and then ceases operation for several minutes, allowing for the dissipation of any ozone that may have been formed by the high-voltage pulses. The ignitor then resumes normal operation and this cycle is continuously repeated, resulting in less stress on the ballast system components than would be experienced with a standard ignitor circuit.

In accordance, with the teachings herein, the present invention provides a reduced duty cycle ignitor circuit for a high intensity discharge lamp incorporating a thermally timed cycled operation which provides intermittent starting pulses for the high intensity discharge lamp. The intermittent starting pulses provide reduced stress on the ballast, socket and wiring dielectric systems and result in longer electrical lives therefor. The ignitor circuit comprises a capacitor and semiconductor connected in series with a ballast transformer of a starter circuit for the high intensity discharge lamp. The ignitor circuit further comprises a series connected resistor and thermostat, having thermally operated, normally closed electrical contacts, through which current is conducted to charge the capacitor. The thermostat is thermally coupled to the resistor. During operation, current flows through the series connected resistor and thermostat and charges the capacitor to a breakover threshold voltage level of the semiconductor. At that point, the semiconductor conducts and the energy stored in the capacitor is discharged through the semiconductor and a winding of the ballast transformer, which generates a high voltage pulse to start the high intensity discharge lamp. The resistor heats the thermostat during the charging cycle which reaches a temperature at which the normally closed thermostat contacts open. This disables the ignitor circuit until the resistor and thermostat cool and the thermostat contacts close, thereby resuming a thermally timed cycled operation of the ignitor circuit.

In greater detail, in a first embodiment the ignitor circuit comprises a series connected resistor, thermostat and capacitor, and the semiconductor is connected between the thermostat and the capacitor. In a second embodiment, the ignitor circuit comprises a series connected thermostat, resistor and capacitor, and the semiconductor is connected between the resistor and the capacitor. In a third embodiment, the ignitor circuit comprises a series connected resistor, thermostat and capacitor, and the semiconductor is connected between the resistor and the thermostat.

In each of the first, second and third embodiments, an additional impedance can be placed across the thermostat. By placing the impedance across the contacts of the thermostat, the voltage across the opened contacts of the thermostat can be reduced, but the current flowing through the resistor and capacitor will also be reduced to a level which will prevent ignitor operation.

In a further embodiment for a two lead high intensity discharge lamp ignitor, the pulse magnetics comprises an on-board pulse transformer in the ignitor circuit.

In a preferred embodiment, the resistor comprises a hollow core resistor, and the thermostat is inserted into the center of the resistor, to improve the consistency of the thermal response times of the resistor and thermostat combination by reducing the effects of ambient environmental variations in temperature and air flow. In an alternate embodiment, the thermostat comprises a hollow core thermostat, and the resistor is inserted into the center of the thermostat. In another alternate embodiment, the thermostat is mechanically attached to the surface of the resistor.

BRIEF DESCRIPTION OF THE DRAWINGS

The foregoing objects and advantages of the present invention for a reduced duty cycle high intensity discharge lamp ignitor may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
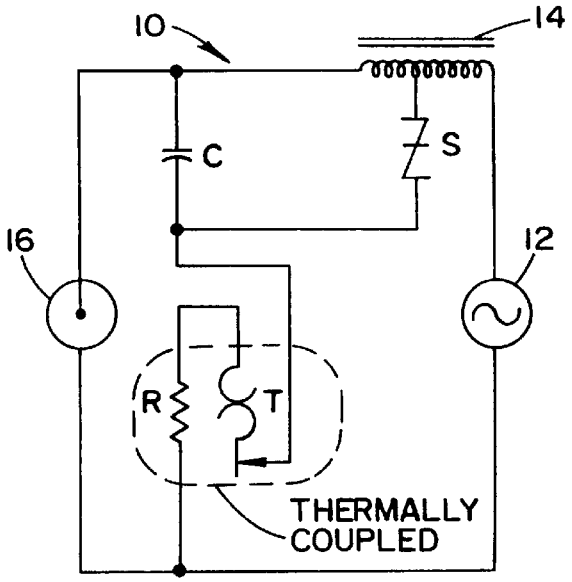
FIG. 1 illustrates a first embodiment of a reduced duty cycle high intensity discharge lamp Ignitor pursuant to the teachings of the present invention.

Referring to the drawings in detail, FIG. 1 illustrates a first embodiment of a reduced duty cycle high intensity discharge lamp ignitor circuit pursuant to the teachings of the present invention. The circuit of FIG. 1 comprises a power supply 12, a capacitor C and semiconductor S connected in series across a portion of the ballast winding 14 for a high intensity discharge (HID) lamp 16, and a resistor R and thermostat T, through which current is conducted to charge the capacitor C.

During each half-cycle of operation, current flows through the series connected Resistor R, Thermostat T, and Capacitor C until the capacitor C charges to the breakover threshold voltage level which causes the semiconductor S to conduct. As the semiconductor S conducts, the energy stored in the capacitor C is discharged through the semiconductor S and a portion of the ballast winding. This discharge, by transformer action, generates the high voltage pulse to start the HID lamp.

The difference between the circuit of the present invention and the prior art is the inclusion therein of the thermostat T. The thermostat T is thermally coupled (placed in contact or in close proximity) to the resistor R. As the resistor R heats during the charging and starting cycle, it will reach a surface temperature causing the normally closed thermostat T contacts to open which will stop current flow through the RC combination, thus disabling the ignitor circuit. But as the ignitor circuit is no longer drawing current through the resistor R and capacitor C, the resistor R cools and the thermostat T closes after several minutes, which in turn allows the ignitor circuit to reestablish operation.

Figure 2:
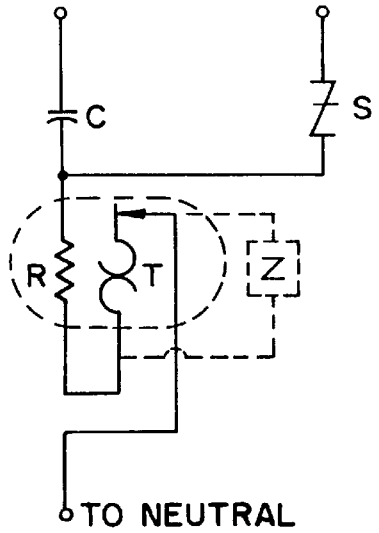
FIG. 2 illustrates a second embodiment of the present invention wherein the series connection of the thermostat T and resistor R are reversed with respect to the circuit of FIG. 1.

The ignitor circuit of FIG. 2 is a second embodiment of the present invention, and illustrates another connection of the thermostat T in the ignitor circuit, with T and R being switched, although the operation of the circuit of FIG. 2 is substantially identical to that of the circuit of FIG. 1.

Figure 3:
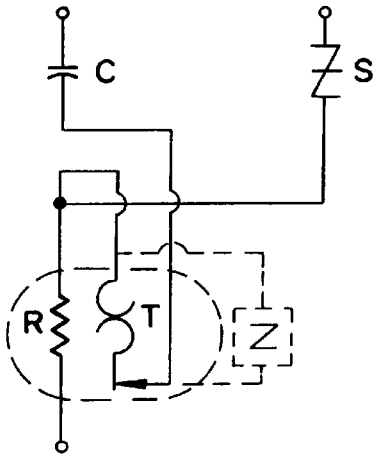
FIG. 3 is a third embodiment of the present invention which places the thermostat T in the capacitor leg of the ignitor circuit.

The ignitor circuit of FIG. 3 is a third embodiment of the present invention, and places the thermostat T in the capacitor leg of the ignitor circuit which functions similarly to the circuits of FIGS. 1 and 2. The difference is that the semiconductor S will conduct during each half cycle of operation and allow for some residual heating of the resistor R. The configuration of FIG. 3 could be employed if the cool down time of the resistor R, i.e. the disable time of the ignitor circuit, is too short.

Figure 4:
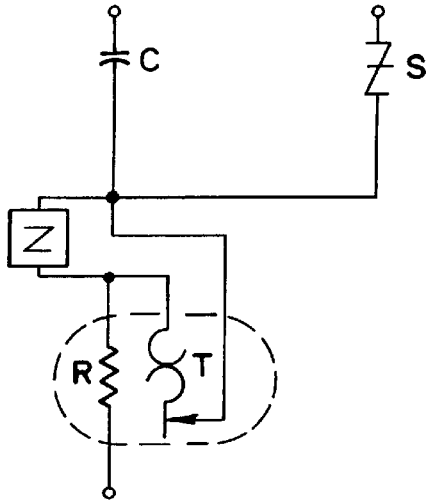
FIG. 4 illustrates a further embodiment of the present invention similar to the ignitor circuit of FIG. 1, but with the inclusion of an impedance Z placed across the thermostat T contacts.

FIG. 4 illustrates a further embodiment of the present invention similar to the ignitor circuit of FIG. 1, but with the inclusion of an impedance Z placed across the thermostat T contacts. This ignitor circuit can be particularly useful if the thermostat T is not rated for the full open-circuit voltage of the ballast. By placing this impedance Z across the contacts of the thermostat T, the voltage across the opened contacts of the thermostat T can be reduced, but the current flowing through the resistor R and capacitor C will also be reduced to a level which will prevent ignitor operation. The principle of operation of this circuit can also be applied to the circuits of FIGS. 2, 3, 5 and 6 as illustrated schematically by the inclusion of an impedance Z shown in phantom in those circuits.

Figure 5:
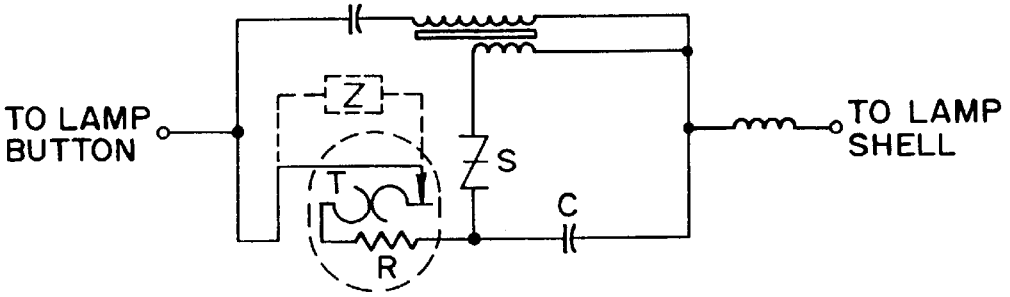
FIG. 5 illustrates a further embodiment of the present invention wherein the concept is applied to a two-lead style high intensity discharge ignitor circuit.

FIG. 5 illustrates a further embodiment of the present invention wherein the concept is applied to two-lead style H.I.D. ignitors, as are being employed commercially by some manufacturers. A two-lead ignitor circuit is essentially the same as the above described three-lead ignitor circuits with the exception that the transformer action is executed by an on-board pulse transformer, and thus a separate ballast transformer is not employed for generation of the starting pulses.

Figure 6:
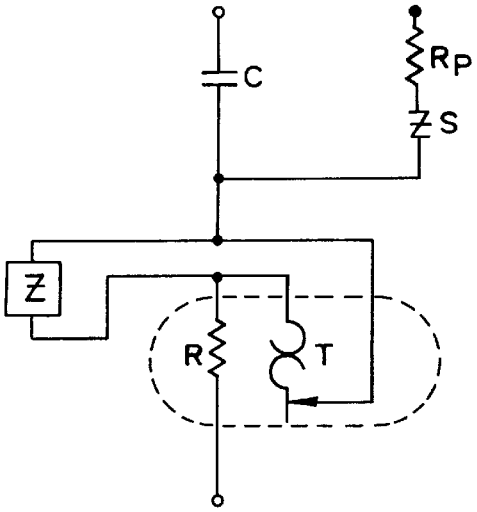
FIG. 6 illustrates a further embodiment of the present invention which places a resistor Rp in series with the semiconductor S to limit the pulse current through S.

FIG. 6 illustrates a further embodiment of the present invention which places a resistor Rp in series with the semiconductor S to limit the pulse current through S.

Figure 7:
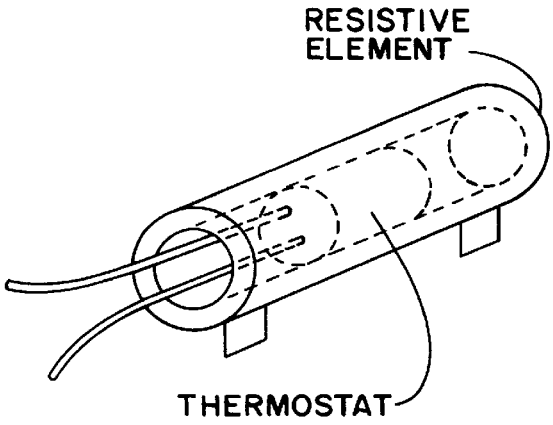
FIG. 7 illustrates a preferred arrangement for thermally coupling the thermostat T and the resistor R, and employs a hollow core resistor with the thermostat being inserted into the center of the resistor.

FIG. 7 illustrates a preferred arrangement for thermally coupling the thermostat T and the resistor R, and employs a hollow core resistor R with an appropriate inner diameter, such that the thermostat T can be inserted into the center of the resistor R. This arrangement improves the consistency of the thermal response times of the resistor R/thermostat T combination by reducing the effects of ambient environmental variations (in temperature, air flow, etc.). In an alternative embodiment the thermostat T can be placed on the outside of the resistor R, but the variation in time cycles as a function of environmental conditions would be more pronounced.

Figure 8:
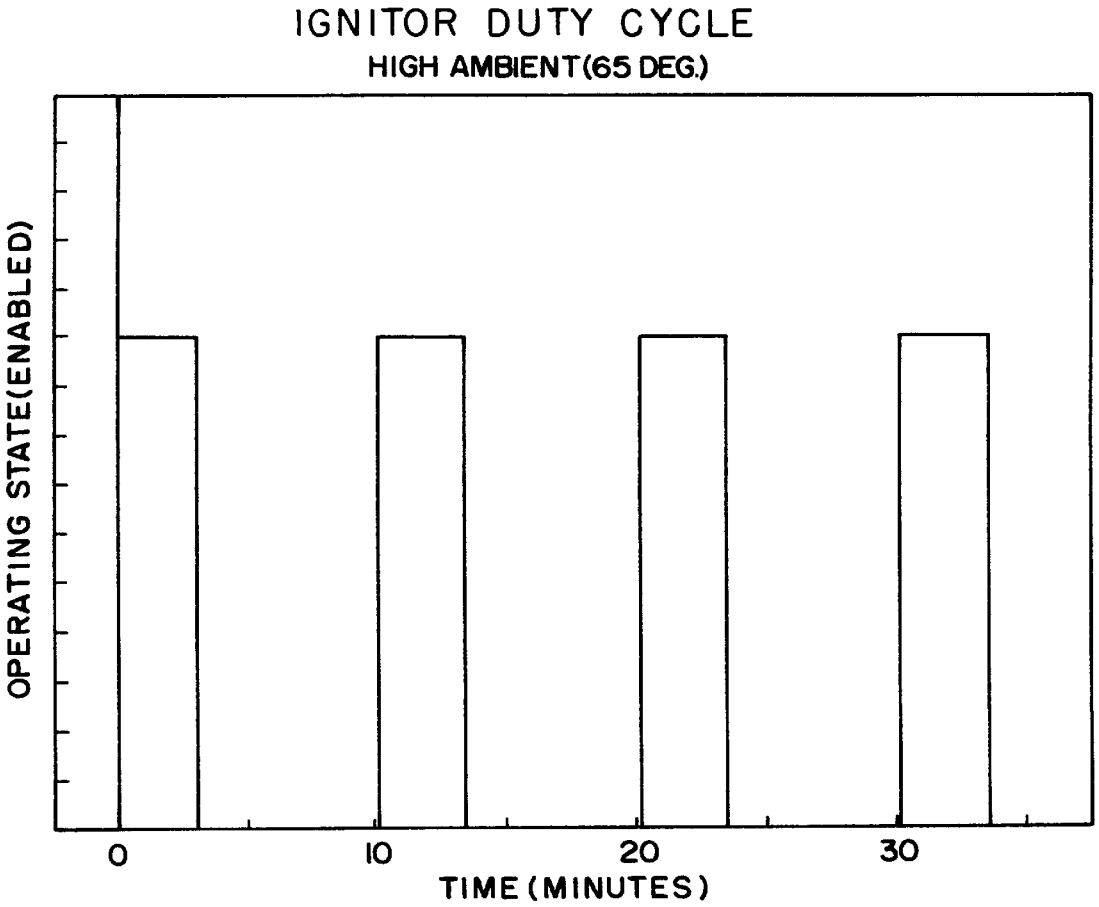
FIG. 8 is a graph of ignitor operation as a function of time for one embodiment of the present invention.

FIG. 8 is a graph of ignitor operation as a function of time for one embodiment of the present invention under the following conditions:

Luminaire Type: Tri-Bay(Industrial)

Lamp Wattage and Type: 400W Metal-Halide

Ballast Type: Electro-Reg

Ambient Temperature: 65° C.

Conditions: Lamp operating for more than 24 hours. Lamp then removed from circuit to simulate failed lamp condition.

The graph shows that the ignitor circuit operates for approximately 3 minutes, and then stops for approximately 7 minutes. The ratio of the on/off times will vary as a function of thermostat operating temperatures and luminaire ambient temperatures.

While several embodiments and variations of the present invention for a reduced duty cycle high intensity discharge lamp ignitor circuit are described in detail herein, it should be apparent that the disclosure and teachings of the present invention will suggest many alternative designs to those skilled in the art.

What is claimed is:

1. A reduced duty cycle ignitor circuit for a high intensity discharge lamp incorporating a thermally timed cycled operation which provides intermittent starting pulses for the high intensity discharge lamp to provide reduced stress on the ballast, socket and wiring dielectric systems of the lamp and result in longer electrical lives therefor, comprising a capacitor and semiconductor connected in series with a ballast transformer of a starter circuit for the high intensity discharge lamp, and a series connected resistor and thermostat, having thermally operated, normally closed electrical contacts, through which current is conducted to charge the capacitor, wherein the thermostat is thermally coupled to the resistor, and during operation current flows through the series connected resistor and thermostat and charges the capacitor to a breakover threshold voltage level of the semiconductor, at which the semiconductor conducts and the energy stored in the capacitor is discharged through the semiconductor and a winding of the ballast transformer which generates a high voltage pulse to start the high intensity discharge lamp, and the resistor heats the thermostat during the charging cycle which reaches a temperature at which the normally closed thermostat contacts open to disable the ignitor circuit until the resistor and thermostat cool and the thermostat contacts close, thereby resuming a thermally timed cycled operation of the ignitor circuit.

2. A reduced duty cycle ignitor circuit for a high intensity discharge lamp as claimed in claim 1, wherein the semiconductor is connected between the thermostat and the capacitor.

3. A reduced duty cycle ignitor circuit for a high intensity discharge lamp as claimed in claim 2, wherein an additional impedance is placed across the thermostat.

4. A reduced duty cycle ignitor circuit for a high intensity discharge lamp as claimed in claim 2, wherein the resistor comprises a hollow core resistor, and the thermostat is inserted into the center of the resistor, to improve the consistency of the thermal response times of the resistor and thermostat combination by reducing the effects of ambient environmental variations in temperature and air flow.

5. A reduced duty cycle ignitor circuit for a high intensity discharge lamp as claimed in claim 2, wherein the thermostat comprises a hollow core thermostat, and the resistor is inserted into the center of the thermostat.

6. A reduced duty cycle ignitor circuit for a high intensity discharge lamp as claimed in claim 1, wherein the semiconductor is connected between the resistor and the capacitor.

7. A reduced duty cycle ignitor circuit for a high intensity discharge lamp as claimed in claim 6, wherein an additional impedance is placed across the thermostat.

8. A reduced duty cycle ignitor circuit for a high intensity discharge lamp as claimed in claim 6, wherein the resistor comprises a hollow core resistor, and the thermostat is inserted into the center of the resistor, to improve the consistency of the thermal response times of the resistor and thermostat combination by reducing the effects of ambient environmental variations in temperature and air flow.

9. A reduced duty cycle ignitor circuit for a high intensity discharge lamp as claimed in claim 6, wherein the thermostat comprises a hollow core thermostat, and the resistor is inserted into the center of the thermostat.

10. A reduced duty cycle ignitor circuit for a high intensity discharge lamp as claimed in claim 1, wherein the semiconductor is connected between the resistor and the thermostat.

11. A reduced duty cycle ignitor circuit for a high intensity discharge lamp as claimed in claim 10, wherein an additional impedance is placed across the thermostat.

12. A reduced duty cycle ignitor circuit for a high intensity discharge lamp as claimed in claim 10, wherein the resistor comprises a hollow core resistor, and the thermostat is inserted into the center of the resistor, to improve the consistency of the thermal response times of the resistor and thermostat combination by reducing the effects of ambient environmental variations in temperature and air flow.

13. A reduced duty cycle ignitor circuit for a high intensity discharge lamp as claimed in claim 10, wherein the thermostat comprises a hollow core thermostat, and the resistor is inserted into the center of the thermostat.

14. A reduced duty cycle ignitor circuit for a high intensity discharge lamp as claimed in claim 1, wherein an additional impedance is placed across the thermostat.

15. A reduced duty cycle ignitor circuit for a high intensity discharge lamp as claimed in claim 1, wherein the resistor comprises a hollow core resistor, and the thermostat is inserted into the center of the resistor, to improve the consistency of the thermal response times of the resistor and thermostat combination by reducing the effects of ambient environmental variations in temperature and air flow.

16. A reduced duty cycle ignitor circuit for a high intensity discharge lamp as claimed in claim 1, wherein the thermostat comprises a hollow core thermostat, and the resistor is inserted into the center of the thermostat.

17. A reduced duty cycle ignitor circuit for a high intensity discharge lamp as claimed in claim 1, wherein a further resistor is placed in series with the semiconductor to limit the pulse current through the semiconductor.

* * * * *